US012410995B2

(12) United States Patent
Caldwell

(10) Patent No.: US 12,410,995 B2
(45) Date of Patent: Sep. 9, 2025

(54) DIVERSIONARY DEVICE WITH ELECTRONIC TRIGGER AND DIRECTED HIGH EFFICIENCY OUTPUT

(71) Applicant: Marcus Caldwell, Colorado Springs, CO (US)

(72) Inventor: Marcus Caldwell, Colorado Springs, CO (US)

( * ) Notice: Subject to any disclaimer, the term of this patent is extended or adjusted under 35 U.S.C. 154(b) by 83 days.

(21) Appl. No.: 18/505,526

(22) Filed: Nov. 9, 2023

(65) Prior Publication Data

US 2024/0302146 A1 Sep. 12, 2024

Related U.S. Application Data

(60) Provisional application No. 63/489,358, filed on Mar. 9, 2023.

(51) Int. Cl.

| | |
|---|---|
| ***F42B 27/00*** | (2006.01) |
| ***F42B 8/26*** | (2006.01) |
| ***F42B 12/36*** | (2006.01) |
| ***F42B 12/42*** | (2006.01) |
| ***F42B 12/46*** | (2006.01) |
| ***F42C 9/02*** | (2006.01) |
| ***F42C 11/00*** | (2006.01) |
| ***F42C 11/06*** | (2006.01) |
| *F42C 19/08* | (2006.01) |

(52) U.S. Cl.

CPC ..... *F42B 12/42* (2013.01); *F42B 12/46* (2013.01); *F42C 9/02* (2013.01); *F42C 11/06* (2013.01); *F42C 19/0803* (2013.01)

(58) Field of Classification Search

None

See application file for complete search history.

(56) References Cited

U.S. PATENT DOCUMENTS

| | | | | |
|---|---|---|---|---|
| 6,543,364 | B2 * | 4/2003 | Wes | F42B 12/42 102/490 |
| 7,191,708 | B2 * | 3/2007 | Ouliarin | F42B 8/18 102/513 |
| 7,975,615 | B1 * | 7/2011 | Apple | F42B 8/26 102/512 |
| 9,261,339 | B2 * | 2/2016 | Mancini | F42B 12/42 |
| 10,184,769 | B2 * | 1/2019 | Muster | F42C 15/184 |
| 11,243,057 | B2 * | 2/2022 | Caldwell | F42B 8/26 |
| 11,460,280 | B2 * | 10/2022 | Thomas | F42B 27/08 |
| 12,104,886 | B1 * | 10/2024 | Grassi | F42B 27/00 |
| 2002/0108526 | A1 * | 8/2002 | Wes | F42B 8/26 102/482 |
| 2010/0282109 | A1 * | 11/2010 | Caldwell | F42B 8/28 102/367 |
| 2013/0104766 | A1 * | 5/2013 | Thomas | F42B 8/26 102/487 |
| 2015/0285602 | A1 * | 10/2015 | Mancini | F42B 12/42 102/360 |
| 2016/0238357 | A1 * | 8/2016 | Ellis | F42C 14/02 |

(Continued)

*Primary Examiner* — Derrick R Morgan

(57) ABSTRACT

A single use diversionary device having a semi-hollow barrel with a closed first end forming a pressure-resistant bulkhead and a second open end that receives one or more powder filled cartridge assemblies. A pivotable gate is mounted at the second open end of the barrel and configured to direct an explosion in more than one direction. A cap containing electronic delay circuitry is attached to the first closed end.

11 Claims, 11 Drawing Sheets

(56) References Cited

U.S. PATENT DOCUMENTS

| | | | | |
|---|---|---|---|---|
| 2017/0102219 | A1* | 4/2017 | Grassi | F42B 27/00 |
| 2017/0276464 | A1* | 9/2017 | Cayer | F42B 27/00 |
| 2018/0283836 | A1* | 10/2018 | Thomas | F42B 12/42 |
| 2019/0145747 | A1* | 5/2019 | Thomas | F42C 9/14<br>102/487 |
| 2020/0333119 | A1* | 10/2020 | Caldwell | F42B 12/36 |
| 2023/0272992 | A1* | 8/2023 | Petersen | F41A 21/36<br>89/14.3 |

* cited by examiner

Cross-Section Of M201A1 Fuse

DIVERSIONARY DEVICE WITH ELECTRONIC TRIGGER AND DIRECTED HIGH EFFICIENCY OUTPUT

CROSS REFERENCE TO RELATED APPLICATION

This application claims the benefit U.S. Provisional Patent Application Ser. No. 63/489,358 filed Mar. 9, 2023, the contents of which are hereby incorporated by reference in their entirety.

BACKGROUND OF THE INVENTION

The present invention pertains to a diversionary device with electronic trigger and directed high efficiency output and more particularly to a noise-flash diversionary device (NFDD) commonly known as a flash bang for use in the field of tactical and special forces operations.

Conventional NFDD's (flash bangs) are known in the art and generate vast amounts of room-filling smoke upon detonation, sometimes completely obscuring the vision of the user. This is due to the inefficient and incomplete reaction of the explosive materials. A typical flash bang contains volatile flash powders made from gunpowder and oxidizers pre-mixed and loaded inside a cardboard sleeve. This creates a dangerous, highly volatile and chemically unstable device.

Conventional NFDD's (flash bangs) are heavy and use an unreliable chemical delay fuse (typically an M201A1) coupled to a percussion style primer to initiate the reaction. This design approach results in misfires and dangerous hang fires (which can inadvertently detonate when moved). NFDD's (flash bangs) generate very high temperatures which typically exceed the ignition point of surrounding materials, often setting fire to the home or building. NFDD's cannot be remotely (wirelessly) triggered due to the antiquated M201A1 mechanically actuated fuse.

In wet or rainy conditions, NFDD's will not detonate because the internal cardboard sleeve containing the powders is susceptible to moisture damage. Conventional NFDD's must be physically larger and heavier in order to provide equivalent decibel output, over pressure and flash brightness levels as the device proposed herein. Conventional NFDD's release burning flash powder mix parallel to the floor, below eye level, resulting in secondary fragmentation and the ignition of flammable objects in its path.

In some cases, NFDD's use a metal ball and valve arrangement to direct the flash powders in a preferred direction. This design is effective; however, the valve restricts the proper mixing and dispersion of the energetic materials. The result is an inefficient chemical reaction generating unburned powders and large quantities of smoke. In some cases, NFDD's use a steel bulkhead and large bolts to contain the internal pressures generated during the detonation. This approach further increases the size, weight and cost of the device. Also, some NFDD's use a complicated microprocessor-based control circuit and unpredictable software adding further complexity, cost and issues with reliability under harsh conditions.

All NFDD's require a fuse to create a slight delay (typically 1.5 seconds) before the device detonates. The delay starts after the pin is pulled and the safety lever is released by the operator. All known conventional devices currently on the market incorporate a the traditional M201A1 fuse which was invented prior to World War II.

This type of fuse is known to be unreliable, exhibits wide variation in the actual delay period and is expensive and difficult to manufacture.

SUMMARY OF THE INVENTION

The present invention seeks to provide a solution to these problems by providing the following novel design features and advanced construction:

An innovative mechanical architecture and simplified analog-based electronic fuse integrated into a small, lightweight package that simultaneously generates ear splitting sound pressure levels (+175 dB) and a blinding white flash exceeding 8 million candelas. The unique exhaust path design and burst cartridge technology yields thorough and complete mixing of the reagents and promotes a highly efficient chemical reaction resulting in very little residual smoke and unburned particles.

An innovative and novel electronic fuse is presented herein, designed to replace the antiquated M201A1 fuse. This fuse yields dramatic improvements in timing accuracy (+/−0.02 sec variation vs. +/−0.5 sec variation) and reliability for the end user. The simplified, low-cost electronic circuitry takes advantage of a property found in all electric primers (also known as squibs, electric matches, initiators, etc.). Electric primers use a tungsten "bridge" wire which is designed to rapidly burn through once a specific current and voltage is applied, thereby initiating a chain reaction within the device. The electronic circuit presented here takes advantage of this unique property of electric primers. This design approach also permits the use of inexpensive, low power components and a reduced number of parts on the circuit board. The small footprint of the board also simplifies packaging and keeps the size and weight of the device to a minimum. The small footprint of the circuit board can fit inside a typical M201A1 fuse, potentially updating the antiquated design.

The fuse architecture described herein also introduces the novel idea of an "electronic" striker. In stark contrast, the striker in a typical fuse (i.e., M201A1) hits a primer with a firing pin with sufficient force to detonate the primer, and subsequently triggering the device. The electronic striker has been engineered to serve a dual purpose; both providing the stored energy to release the safety lever and provide power to the electronic circuit. When the lever is released, a pre-formed section of the spring makes a physical connection with a pair of switch contacts triggering the timing circuit. When in storage, the contacts are safely hidden under the lever. This action completes a circuit, providing power to the electronic fuse. The typical hammer and firing pin found in the M201A1 fuse is eliminated, thereby improving reliability, timing accuracy, reducing the number of parts and improving operator safety.

Further, an arrangement of frangible cartridges is described within, each containing different ratios of energetic materials inside the device. The contents of the individual cartridges are "chemically and reaction speed balanced" to improve efficiency, output power and help reduce smoke.

An optimized chemical formula with fewer reagents to further improve the speed and efficiency of the explosive event.

A frangible cartridge with an energy absorbing coating that uniformly distributes the internal explosive pressures throughout the device allowing the introduction of lightweight construction materials such as aluminum, composites and engineered polymers for the main body of the device.

The energy absorbing coating on the cartridges eliminates the need for heavy steel bulkheads and bulky high-strength bolts found in other devices.

Discrete frangible cartridges maintain complete separation of the energetic materials (powders) until a split second before detonation and contribute to a safe and chemically stable device. The specific mixture of chemicals described in detail later in this application are relatively inert even when exposed to high shock, high heat, sparks or conditions that would normally ignite conventional flash powders.

Hermetically sealed (i.e., both air-tight and water-tight) frangible cartridges are designed to protect the sensitive energetic materials and allow the device to operate in high humidity and damp, wet conditions. Additionally, the individual frangible cartridges are engineered to withstand continuous submersion to 66 feet (20 meters) in salt or fresh water.

The uniqueness and novelty of this design is further expanded by offering an array of frangible cartridges containing tightly controlled mixtures of fuel and oxidizer, isolated from each other in such a way that each frangible cartridge contains differing amounts of both fuel and oxidizer. Current technology only offers one configuration consisting of fuel in one reservoir and the oxidizer in a second reservoir, a single reservoir containing only fuel or a single reservoir with a volatile pre-mix of chemicals. The concept introduced here of a "fuel rich" mixture inside one or more frangible cartridges and additional frangible cartridge containing an "oxidizer rich" mixture yields greatly enhanced sound output performance, improved mixing and higher reaction efficiency. In other possible embodiments, the number of cartridges can expand to 3, 4 or more to achieve the desired effect or contain other materials to produce different distraction effects (CS, smoke, irritants, etc.).

In the first preferred embodiment of the above concept, the fuel component is a finely milled aluminum powder (Al) commonly known as German Blackhead and the oxidizer component is potassium perchlorate (KClO4). The balanced equation for the reaction from the published literature is defined as follows:

$$(8)\ Al+(3)\ KClO4 \rightarrow (3)\ KCl+(4)\ Al2O3$$

In a second preferred embodiment, the ratio of Al to KClO4 in the fuel rich cartridge is 78% fuel and 22% oxidizer. The ratio in the oxidizer rich cartridge is 21% fuel to 79% oxidizer. In high volume manufacturing, the specific ratios may require slight adjustments to accommodate natural variations in the raw materials, however the basic concept of separate cartridges containing premixed low volatility chemistry remains novel and valid.

User safety is dramatically enhanced due to the low volatility of the pre-mixed powders. The pre-mixed formula is well below flash powder levels of volatility. This class of mixture is known as propellants and are considered to be stable and safe to handle. The specific premixed ratios contained in each frangible cartridge remain stable under high heat, external sparks and shock. A further benefit of this approach is that the multi-cartridge concept aids in the manufacturing process since the reactive materials can be kept completely separate until final assembly into the device.

The frangible cartridge assembly is constructed from a thin-walled metal barrel encased in an energy absorbing elastomeric (rubber) sleeve. The energy absorbing coating is molded in such a way to form a frangible or breakaway seal at the exit end and movable hermetic seal at the opposing end. Once the energetic materials are loaded into the barrel during assembly, a plastic wad much like a shotgun shell is inserted into the open end forming a hermetic, watertight enclosure.

Furthering the uniqueness of the device, a bi-directional "blast ramp" located at the distal end of the device forms the final geometry of the exhaust port. The geometry of the exhaust port (cross-sectional area and shape) is optimized to further improve the high-speed mixing of the energetic materials. The bi-directional blast ramp also serves to deflect the energetic materials in the vertical direction (upwards) regardless of the orientation of the device. The blast ramp simultaneously seals off the exhaust port on the bottom surface preventing damage to the surrounding surfaces and effectively eliminating secondary fragmentation. The relationship of the blast ramp pivot point to its center of mass allows gravity to consistently swing the blast ramp into the correct position without fail or outside input.

The unique architecture eliminates the need for a high strength steel bulkhead found in other products, reducing weight, physical size and number of component parts.

The unique mechanical architecture eliminates the need for bolts to contain the pressures created during detonation, reducing weight, physical size and the number of component parts.

The unique mechanical architecture combined with the energy absorbing cartridges eliminates the need for a large heavy body and allows for the use of lightweight materials including aluminum and composite plastics.

An analog electronic delay circuit and Mil Spec battery replaces the function of a chemical delay fuse (M201A1) used in conventional flashbangs. The analog circuit and integral switch (striker) described here replaces the complicated microprocessor-based digital fuse found in other devices on the market.

The analog circuit provides the ability to remotely or wirelessly trigger the device without the complexity of software and digital control.

The antiquated, unreliable striker arrangement found in conventional flashbangs is now modernized by the introduction of a dry contact switch paired with an electrically conductive element formed into a common torsion spring, further simplifying the design and reducing cost.

This has outlined, rather broadly, the features, advantages, solutions, and benefits of the disclosure in order that the description that follows may be better understood. Additional features, advantages, solutions, and benefits of the disclosure will be described in the following. It should be appreciated by those skilled in the art that this disclosure may be readily utilized as a basis for modifying or designing other structures and related operations for carrying out the same purposes of the present disclosure. It should also be realized by those skilled in the art that such equivalent constructions and related operation do not depart from the teachings of the disclosure as set forth in the appended claims. The novel features, together with further objects and advantages, will be better understood from the following description when considered in connection with the accompanying Figures. It is to be expressly understood, however, that each of the Figures is provided for the purpose of illustration and description only and is not intended as a definition of the limits of the present disclosure.

A single use diversionary device includes a semi-hollow barrel having a closed first end forming a pressure-resistant bulkhead and a second open end that receives one or more powder filled cartridge assemblies. A pivotable gate is mounted at the second open end of the barrel and is configured to direct the explosion in more than one direction. A cap containing electronic circuitry is attached to the closed first end. The pivotable gate has a first position that provides an open channel to a first exhaust port and a second position that provides an open channel to a second exhaust port. The pivotable gate is naturally biased in an upward direction due to the influence of gravitational forces to pen the channel to the first exhaust port while simultaneously sealing the second exhaust port on the opposite side of the semi-hollow barrel.

An electronic timing circuit is protected by the cap and configured to generate a pre-defined timing delay, activate an electric primer which subsequently ejects energetic powder materials from the device creating an explosion in free space. The electronic timing circuit includes a timing section, a power source and a lower power relay configured to optimize the fast blow nature of the electric primer. The timing circuit can be adapted for use with conventional diversionary devices due to its small size and minimal number of components. Disposed within the cap is a trigger switch and spring wherein the spring is part of the electrical timing circuit.

The cartridge assemblies include multiple cartridges containing a mixture of energetic material and a breakaway hermetic seal. The multiple cartridges are encased in an elastomeric coating configured to uniformly distribute internal pressures occurring during detonation and have an internal metal sleeve. The multiple cartridges contain specific ratios of energetic material which are chemically stable with low volatility with properties below conventional flash powder thresholds. In one example at least one of the multiple cartridges contains a fuel-rich mixture and at least one of the multiple cartridges contains an oxidizer rich mixture. The multiple cartridges are designed to burst open and complete the mixing of the energetic materials at the exact instant before detonation to flash powder levels. A flash does not occur until the breakaway hermetic seal bursts under pressure.

These and other objectives and advantages will be apparent to one of ordinary skill in the art based on the following written disclosure, drawings and claims.

BRIEF DESCRIPTION OF THE DRAWINGS

The present disclosure may be better understood with reference to the following figures. Corresponding reference numerals designate corresponding parts throughout the figures. Components in the figures are not necessary to scale. It will be appreciated that the drawings are provided for illustrative purposes and that the invention is not limited to the illustrated embodiment. For clarity and in order to emphasize certain features, not all drawings depict all embodiments. The invention also encompasses embodiments that combine features illustrated in multiple different drawings; embodiments that omit, modify, or replace some of the features depicted and embodiments that include features not illustrated in the drawings. Therefore, it should be understood that there is no restrictive one-to-one correspondence between any given embodiment of the invention and any of the drawings provided.

DETAILED DESCRIPTION

Figure 1:
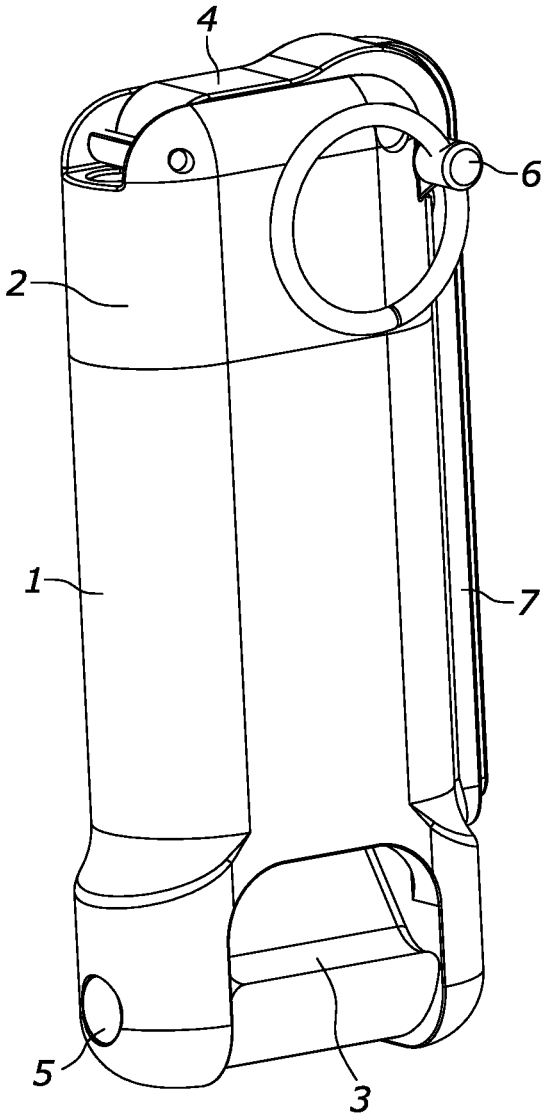
FIG. 1 is an isometric view of one embodiment of an improved noise flash diversionary device highlighting the major components seen by the end user.
Figure 2:
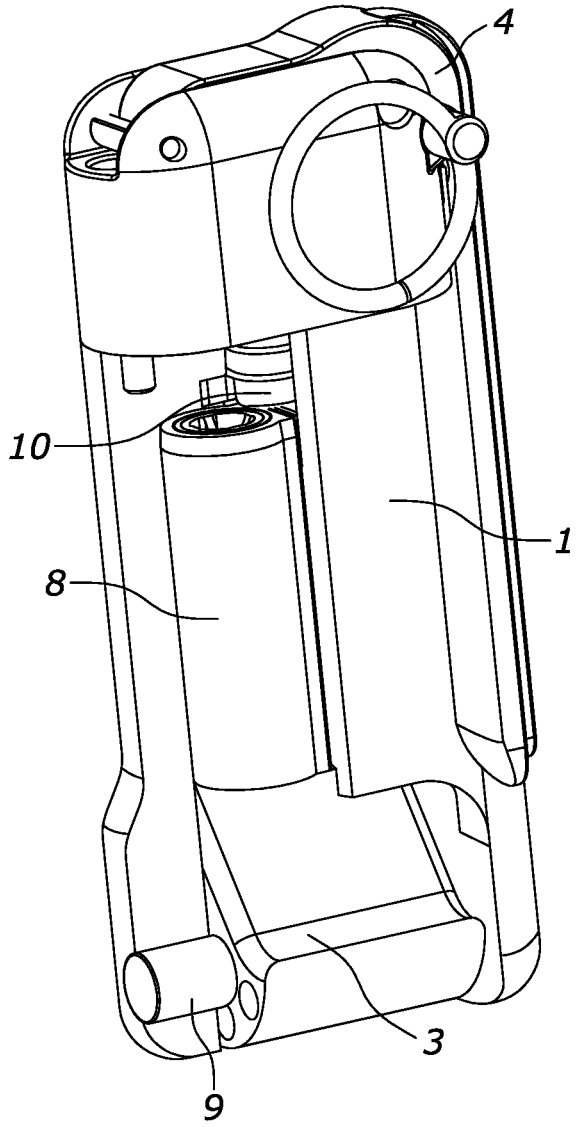
FIG. 2 is a cut-away view of one embodiment of an improved noise flash device revealing the relationship of the frangible cartridge to the external case.
Figure 3:
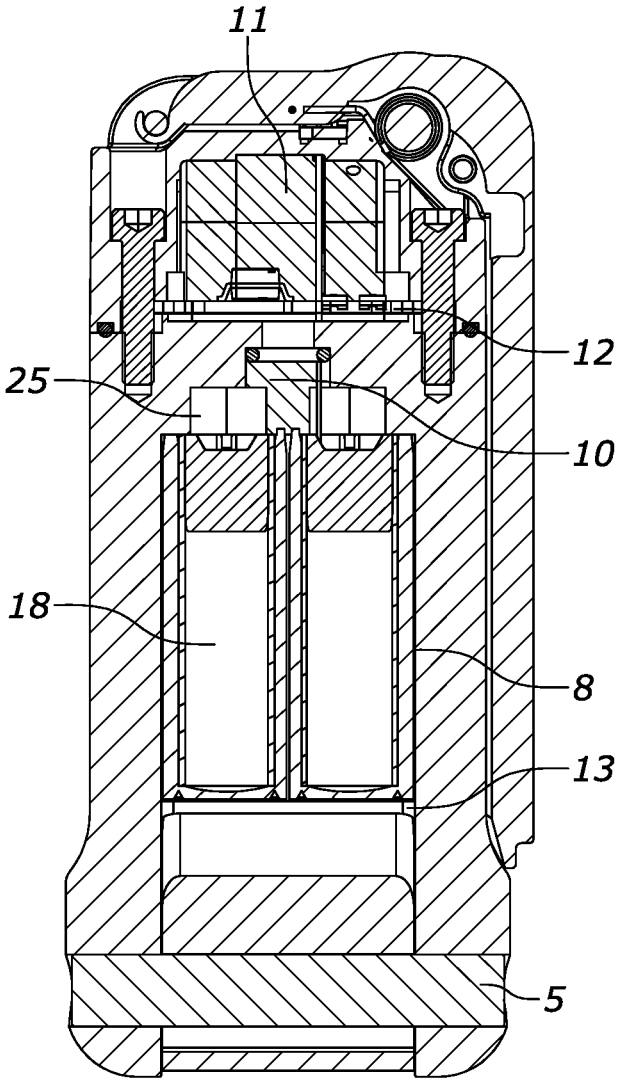
FIG. 3 is a full longitudinal cross-section view of one embodiment of an improved noise flash device illustrating some of the internal components.
Figure 4:
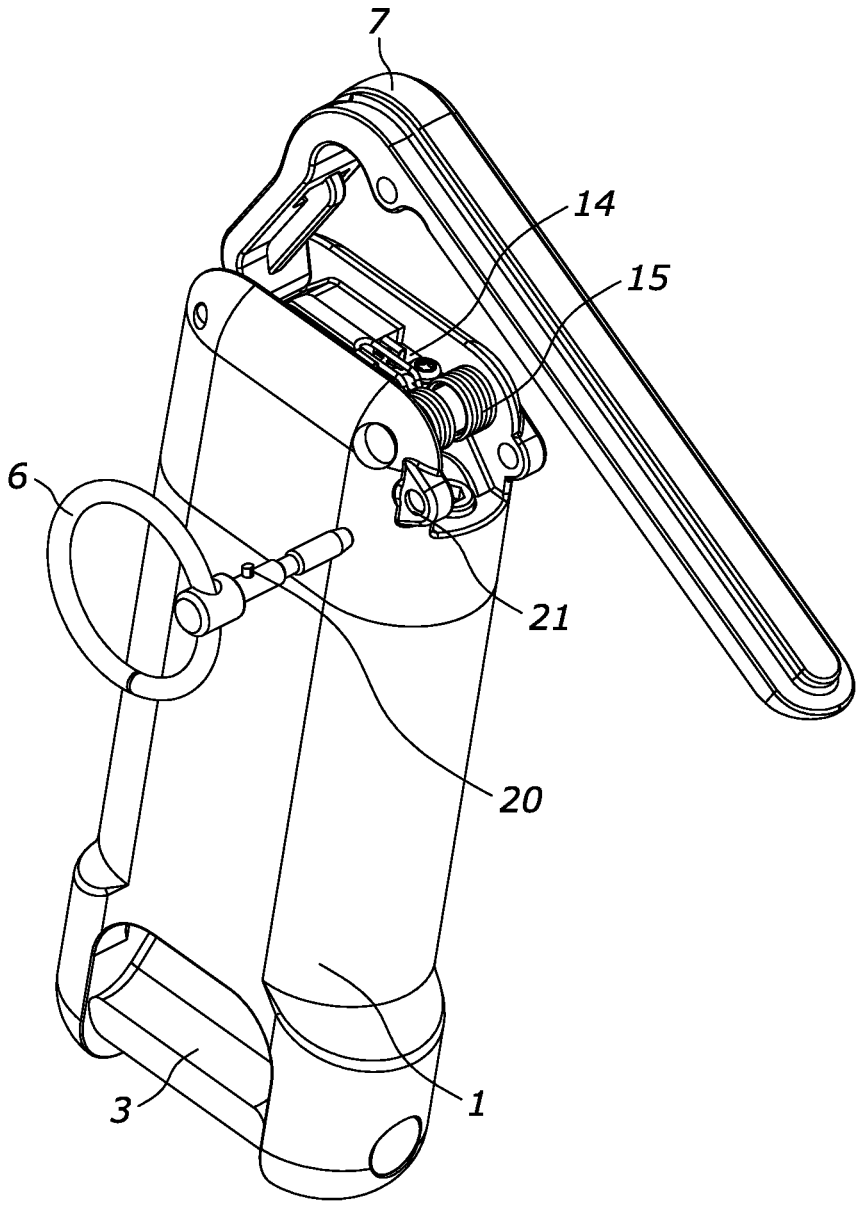
FIG. 4 is a full transverse cross-section view of one embodiment of an improved noise flash device illustrating some of the internal components.
Figure 5:
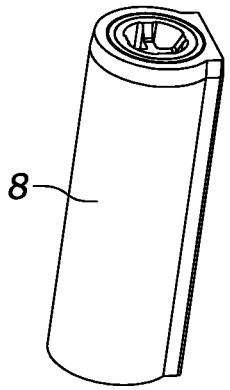
FIG. 5 and FIG. 6 illustrate the three main components of the frangible cartridge assembly and an exploded view of the frangible cartridge.
Figure 6:
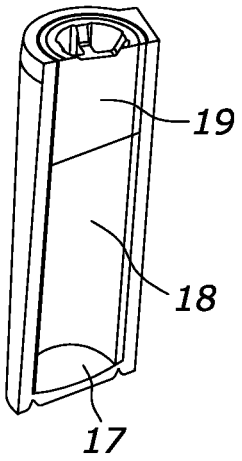
Figure 7:
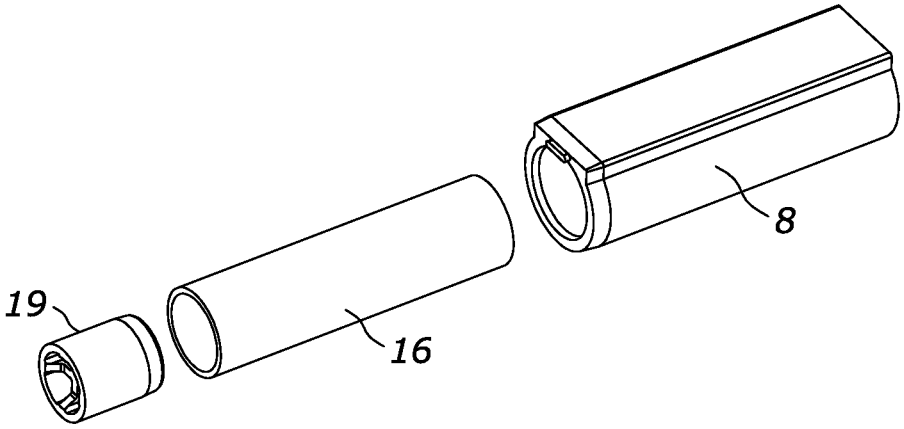
FIG. 7 provides the reader with an exploded view of the frangible cartridge assembly.
Figure 8:
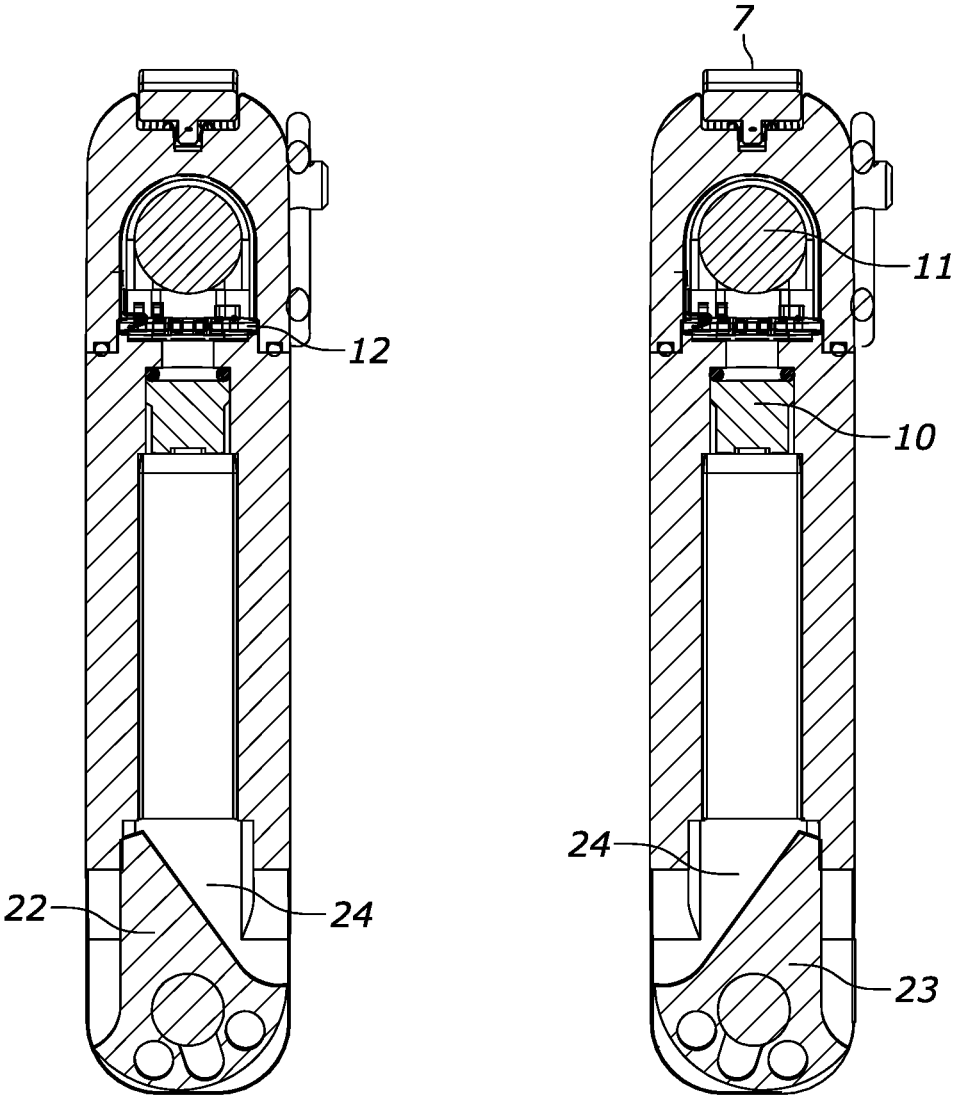
FIG. 8 is an additional cross-section of the device providing a further understanding of the limited motion bi-directional blast ramp and optimized exhaust port.
Figure 9:
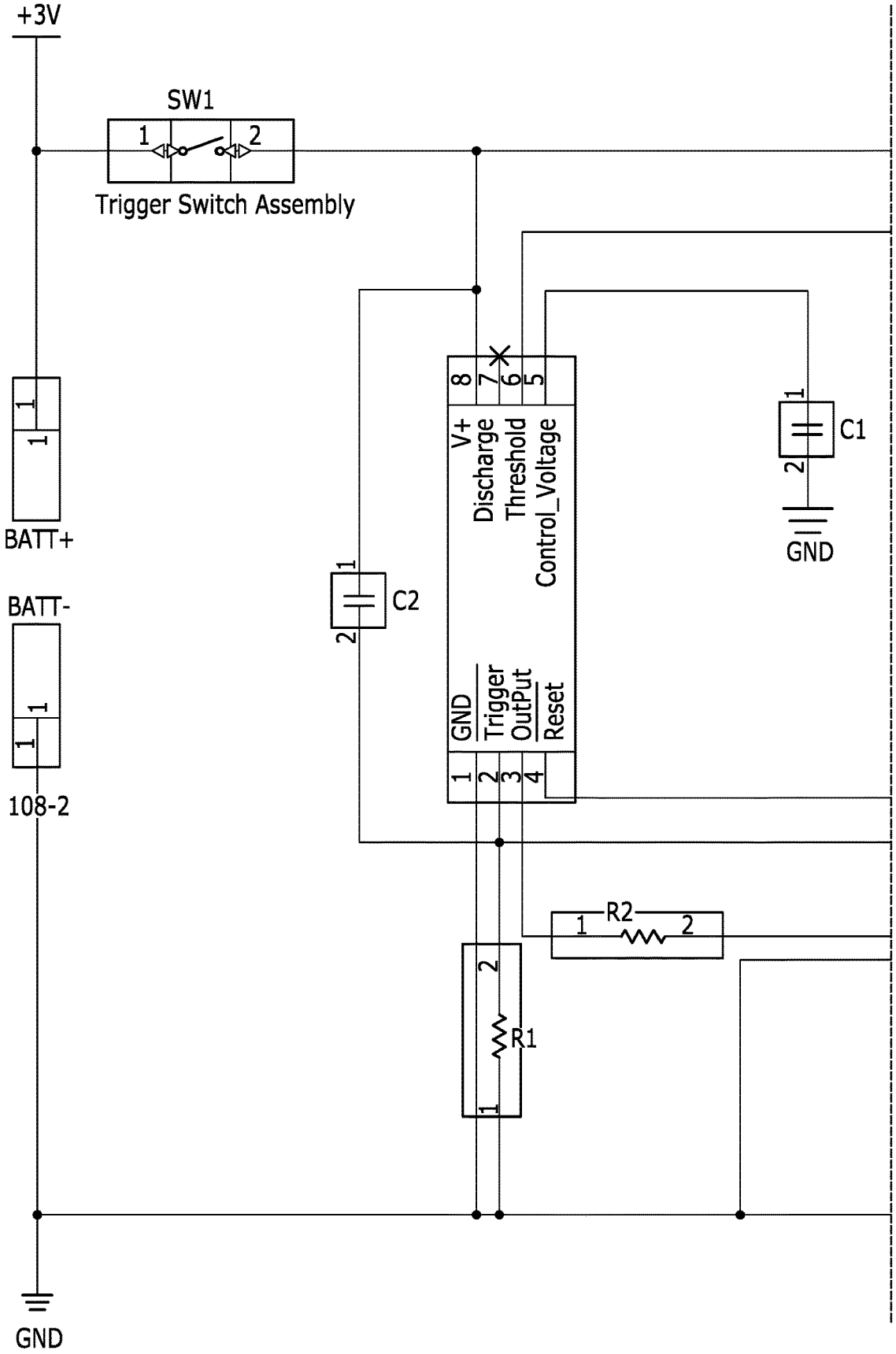
FIG. 9 is the schematic of the proposed electronic delay circuit.
Figure 9:
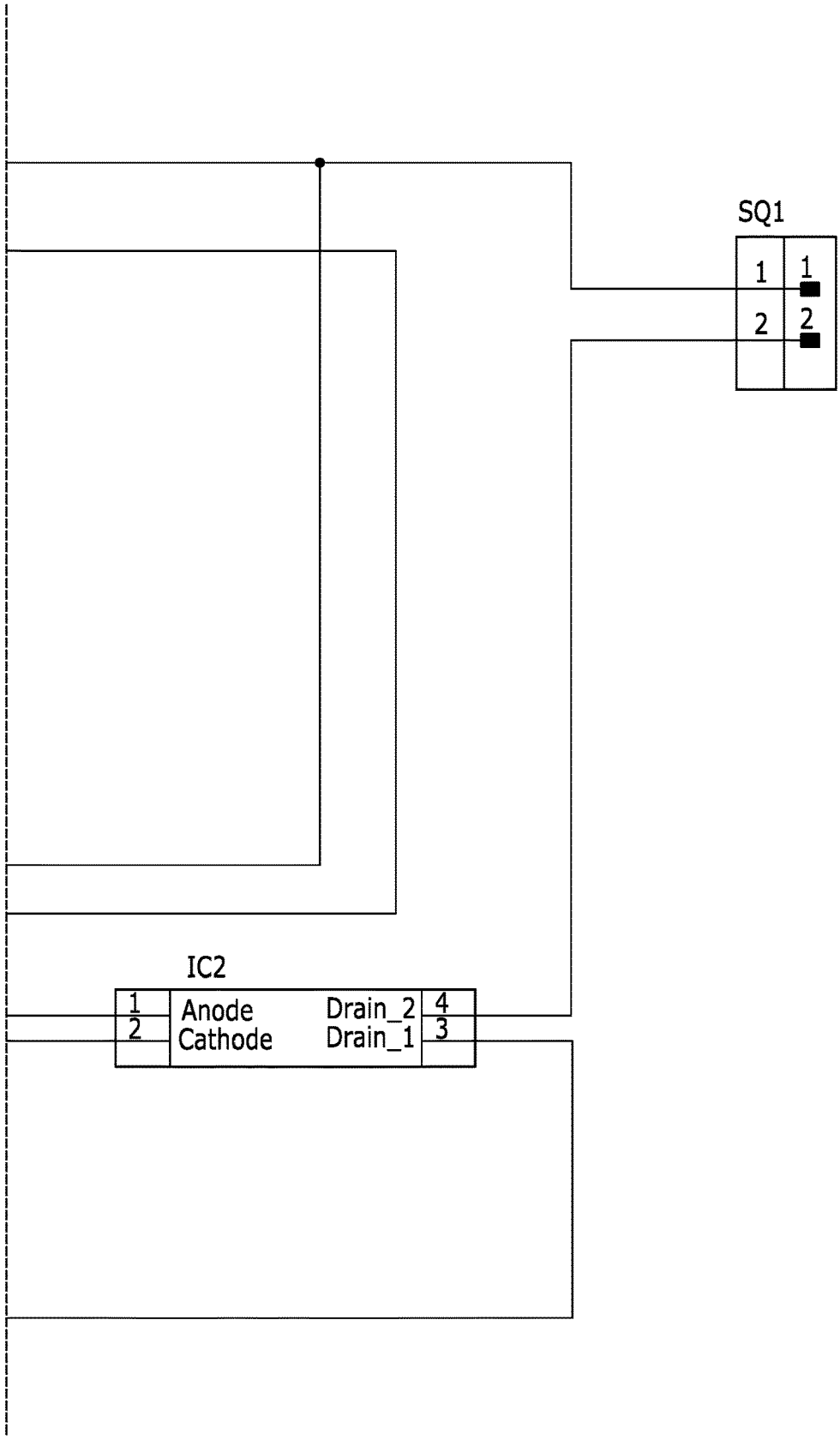
Figure 10:
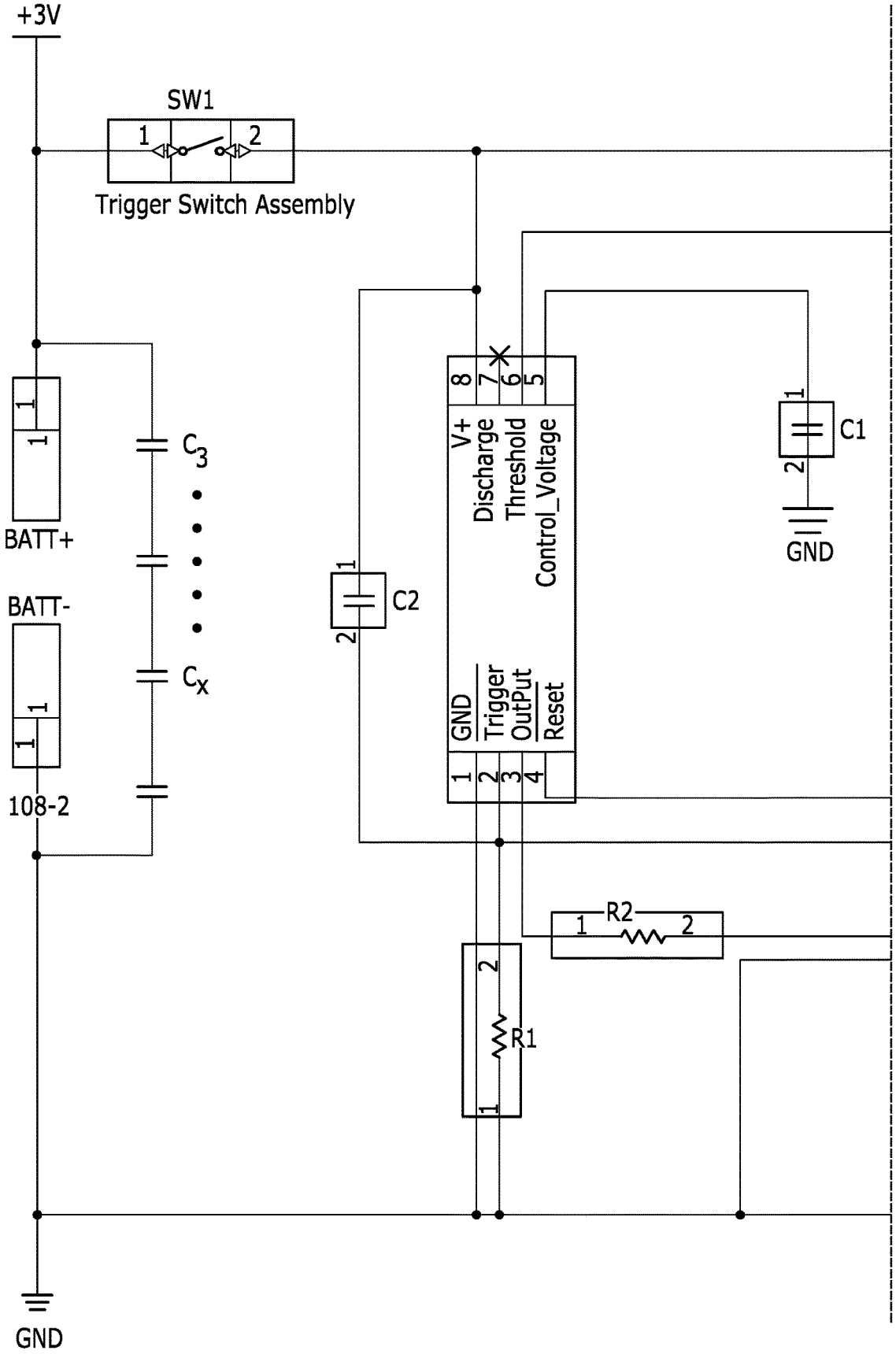
FIG. 10 is an electronic schematic of the fuse circuit with a boost capacitor.
Figure 10:
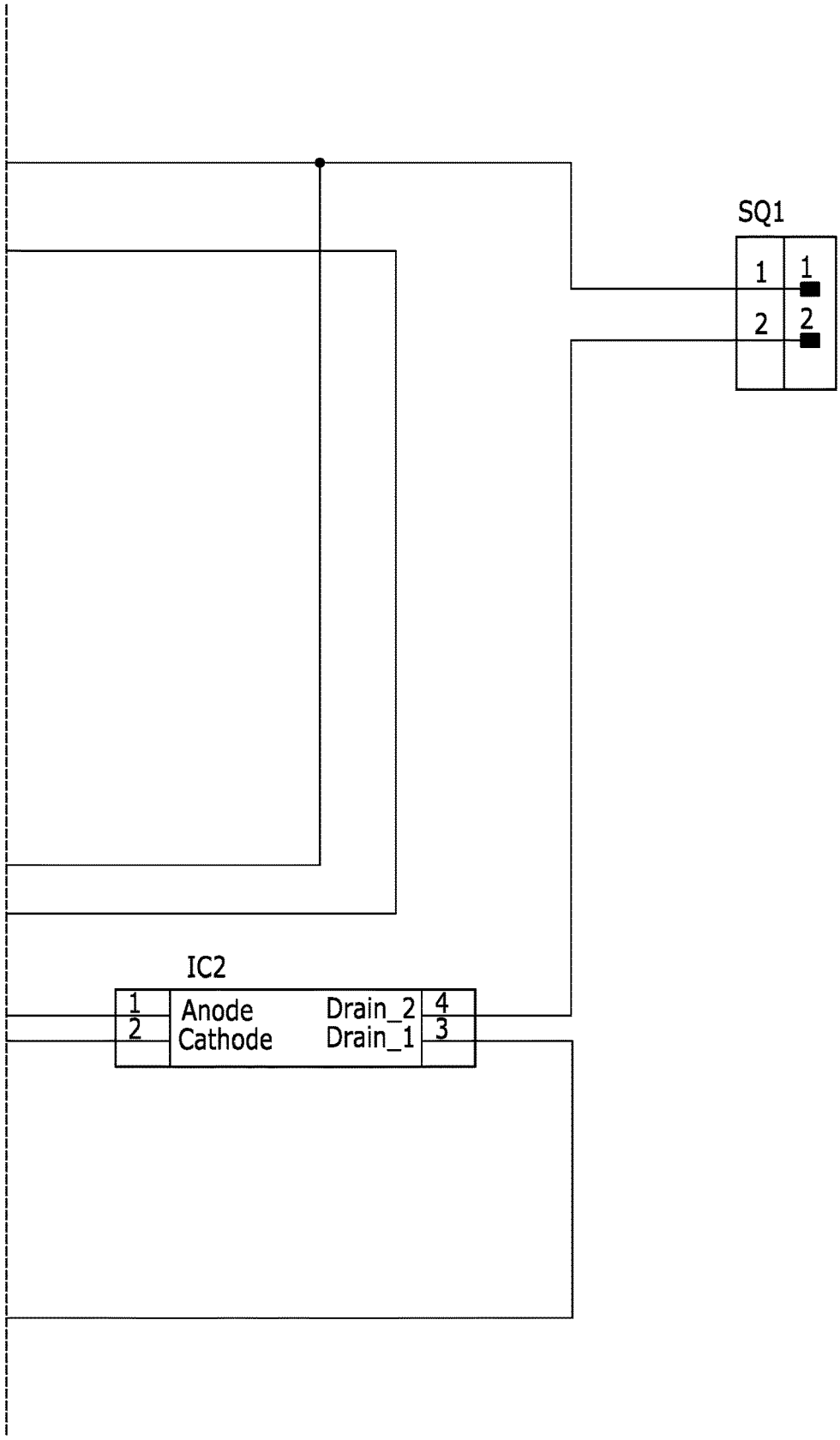
Figure 11:
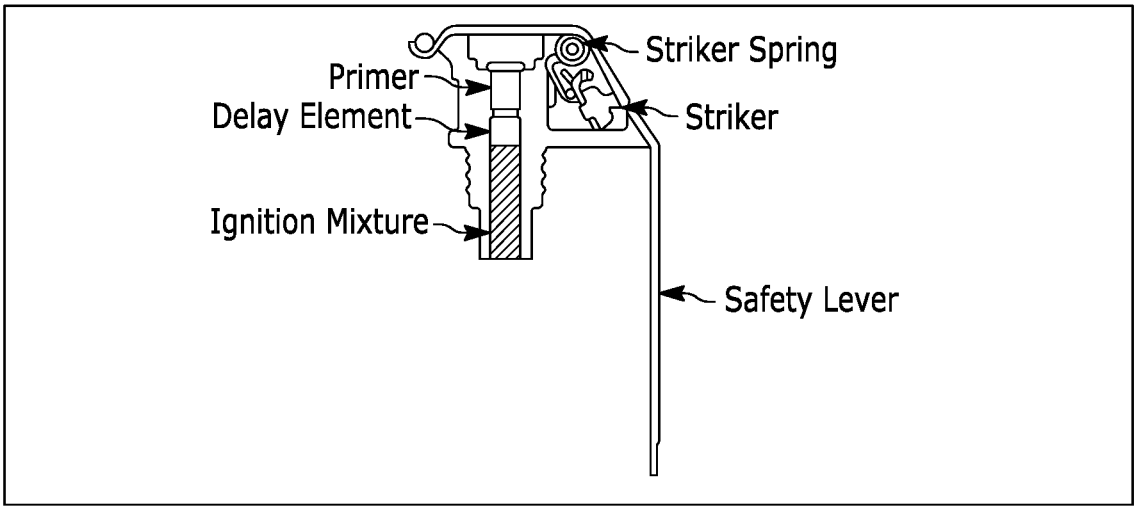
FIG. 11 depicts a cross section of a typical M201A1 fuse.

Referring to the Figures, a diversionary device includes a barrel 1 fabricated from a lightweight material such as aluminum, engineered composite, carbon fiber or similar lightweight material. The barrel 1 is of any size and shape and in the example shown has a stadium or racetrack shape with a first open end and a closed second end. An impact resistant cap 2 is secured to the first open end of the barrel 1. The cap 2 is made of any material and as an example is formed from aluminum, polymer or lightweight materials.

Located at the closed second or distal end of the barrel 1 and disposed within is a bi-directional blast ramp or gate 3 which pivots freely about a pin 5 having an axis perpendicular to a longitudinal axis of the barrel 1. The bi-directional gate 3 is positioned to direct energetic materials away from the device in order to form a volatile aerosol cloud of powder above the device. While the bi-directional gate 3 is constructed from any material, in one example the gate is constructed from high strength, lightweight materials such as aircraft aluminum in order to absorb the extreme overpressures generated by an explosion. The bi-directional gate 3 is configured so that its center of gravity is forward of the pivot point allowing gravitational forces to automatically swing the gate 3 into a correct position.

A spring-loaded safety lever 4 is mounted to the cap 2 and is secured in place using a ring and pin assembly 6. Removal of the pin causes the lever 4 to pivot upward and separate completely from the device. Disposed within the barrel 1 is a frangible cartridge assembly 8. In the example shown a dual frangible cartridge array is shown, however, in other embodiments more than a dual cartridge array is used.

An electric primer 10, also known as a squib, electric match, initiator, or the like, is positioned directly above the frangible cartridge assembly 8 and is electrically connected to an analog control circuitry 12. A battery 11 is connected to the analog control circuitry 12 to provide power to the control circuitry 12. In one example the primer 10 is soldered directly to a circuit board eliminating the need for a connector and securing both the control circuitry 12 and primer 10 in place. An air gap 13 is provided between the cartridge assembly 8 and the bi-directional gate 3.

The cap 2 protects the analog control circuitry 12 which is disposed within the cap 2. A spring 14 is configured to become part of the control circuitry 12 once tension is released and the spring 14 falls into a resting position. In one example the spring is fabricated as a single unitary piece with both left-hand and right-hand wound sections joined together at the center. The connection between the two torsion springs 14 is formed to match exposed contacts on a trigger switch 15. This configuration simplifies the device by using the spring for two purposes—one to provide stored energy to release the lever 4, and two to electrically connect the battery to the analog control circuitry 12.

Each cartridge of the frangible cartridge assembly 8 has an energy absorbing coating and an internal metal sleeve 16. At one end is a break-away frangible seal 17 and at the opposite end is a hermetically sealed end cap 19. Disposed within the cartridge is a volume of pre-mixed energetic material 18. The energy absorbing coating on the frangible cartridges forms a watertight seal once the cartridges are positioned inside the barrel 1.

The ring and pin assembly 6 includes a machined boss 20 that prevents the accidental removal of the pin. A slot 21 is formed in the cap 2 that requires the user to remove the pin and ring assembly 6 at a specific rotational angle. In all other angular positions the ring and pin assembly 6 remains locked in place and cannot be separated from the device. This configuration reduces the number of parts and replaces a wire confidence clip found in other devices.

The bi-directional gate 3 has a first position 22 where the gate 3 is biased to the left or back of the device and a second position 23 where the gate 3 is biased to the right or front of the device. In both positions the bi-directional gate provides a channel 25 to an exhaust port 24. The size and cross-section of the exhaust port 24 in relation to the bi-directional gate 3 and the barrel 1 is configured to match the specific payload and chemistry of the energetic materials 18.

The cartridges 8 are loosely held in place within the barrel 1 and are allowed to slide inside the barrel 1 when the primer 10 is ignited. When the channel 25 is pressurized the cartridges 8 are pushed inside the barrel 1 in unison, closing the air gap 13 and preventing further movement of the bi-directional blast gate 3. Thus, the cartridges 8 are configured to lock the bi-directional gate 3 in place preventing further movement and pinning the bi-directional gate 3 in a desired position during detonation of the device.

The explosive event and simultaneous flash are directed at right angles in all normal situations, up and away from the device. Based on the configuration of the device the explosive event and flash always occurs 5 to 9 feet above the floor which dramatically increases the effectiveness of the device. The bi-directional gate 3 seals against the inside wall of the barrel 1 preventing damage to flammable surfaces under the device.

The configuration of the barrel 1 and bi-directional gate also eliminates the need for reinforced steel bulkhead and heavy case bolts, which provides a significant reduction in both size and weight. Internal pressures generated by the primer are freely dissipated out of the unrestricted open end of the device much like escaping gases from a gun barrel. The open-ended concept allows for the use of lightweight materials and the reduction in the number of parts. Further, most conventional devices severely restrict the flow of energetic material out of the device resulting in very high internal pressures that necessitate the use of heavy materials of construction.

In one example the electric primer 10 is securely mounted in a machined cavity formed in the upper section of the barrel 1 backed by an elastomer seal or O-ring which prevents the internal pressures from escaping from exhaust port 25 preventing damage to the cap 2 and control circuitry 12.

The present invention discloses a low cost, single use device that mandates the creation of a simplified control circuit using the smallest number of components. The control circuit must perform two functions: 1) render the device inert (safe) whenever the safety lever 4 is installed, and 2) provide a means to delay the explosive event for 1 to 2 seconds after the safety lever 4 is released. In one example the control circuit consists of five components—a capacitor, two resistors, and integrated timer chip and a solid-state relay. The required delay is achieved by the proper selection of the capacitor/resistor combination. In one example the target delay is 1.5 seconds but can be easily changed by the selection of the proper resistor/capacitor combination.

To further minimize cost and the number of component parts, the torsion spring 14 provides the stored energy to mechanically release the safety lever 4 from the device and subsequently the electrical trigger board 15 of the electronic circuit 12. This approach eliminates the need for a hammer, spring and firing pin found in conventional devices. This approach ensures the device is rendered safe at all times since no power is available to the device unless the safety lever 4 is removed.

Upon detonation of the primer 10 the following sequence of events occurs, sometimes referred to as the "explosion train." As previously described the pressure generated by the electric primer 10 forces the frangible cartridge assemblies 8 forward directly into the bi-directional gate 3 securely locking the gate 3 in place. The frangible cartridges 8 then burst open, releasing the premixed energetic materials 18 into the exhaust port. The energetic materials 18 deflect off the bi-directional gate 3 forming an aerosol powder cloud in the free air space above the device. The pressurization of the frangible cartridges 8 and subsequent bursting of the frangible seals 17 results in a violent secondary mixing action creating a near perfect fuel air reaction. The improved combustion properties and unrestricted flow of the design generates optimum overpressure (sound) with little or no smoke. In fact, due to the inherent efficiency of the design of the device, only small amounts of energetic material are needed, in some cases less than ½ the payload of other products. Due to its novel construction, the device operates much like the bursting of a high-pressure balloon resulting in the rapid expansion and mixing of its contents, hence generating little or no unburned materials, sparks or smoke.

What is claimed is:

1. A single use diversionary device, comprising:

a semi-hollow barrel having a closed first end forming a pressure-resistant bulkhead and a second open end that receives one or more powder filled cartridge assemblies;

a pivotable gate mounted at the second open end of the barrel and configured to direct an explosion in only one of two possible directions, wherein the pivotable gate is positioned based on an orientation of the diversionary device after the diversionary device is deployed; and a molded cap containing electronic circuitry attached to the closed first end.

2. The single use divisionary device of claim 1 wherein the pivotable gate has a first position that provides an open channel to a first exhaust port and a second position that provides an open channel to a second exhaust port.

3. The single use diversionary device of claim 2 wherein the pivotable gate is weighted such that the influence of gravity positions the pivotable gate to direct exhaust in an upward direction and opens the channel to the first exhaust port while simultaneously sealing the second exhaust port on the opposite side of the semi-hollow barrel.

4. A single-use diversionary device, comprising:

a semi hollow barrel having a closed first end forming a pressure resisting bulkhead and a second open end that receives one or more powder cartridge assemblies;

an upper cap connected to the hollow barrel at the first closed end;

an electronic timing circuit protected by the cap and configured to generate a pre-defined timing delay, activate an electric primer and subsequently eject energetic powder materials from the device thereby creating an explosion in free space;

the electronic timing circuit includes a timing section, a power source and a low power relay configured to capitalize on the fast blow nature of electric primers;

an electronic circuit configured for use with conventional diversionary devices; and a pivotable gate mounted at the second open end of the barrel and configured to direct an explosion in only one of two possible directions, wherein the pivotable gate is positioned based on an orientation of the diversionary device after the diversionary device is deployed.

5. The diversionary device of claim 4 wherein a trigger switch and spring are disposed within the cap, wherein the spring is part of the electrical timing circuit.

6. A diversionary device, comprising:

a semi hollow barrel having a closed first end forming a pressure resisting bulkhead and a second open end that receives one or more powder cartridge assemblies;

the cartridge assembly consisting of multiple cartridges containing a mixture of energetic materials and a breakaway (frangible) hermetic seal;

the multiple cartridges are encased in an elastomeric (rubber) coating configured to uniformly distribute internal pressures occurring during detonation; and a pivotable gate mounted at the second open end of the barrel and configured to direct the pressures during detonation in only one of two possible directions, wherein the pivotable gate is positioned based on an orientation of the diversionary device after the diversionary device is deployed.

7. The diversionary device of claim 6 wherein the cartridges have an internal metal sleeve.

8. The diversionary device of claim 6 wherein the multiple cartridges contain specific ratios of energetic materials which are chemically stable and exhibit properties below conventional flash powder thresholds.

9. The diversionary device of claim 6 wherein at least one of the multiple cartridges contains a fuel-rich mixture and at least one of the multiple cartridges contains an oxidizer rich mixture.

10. The diversionary device of claim 6 wherein the multiple cartridges are configured to burst open and complete the mixing of the energetic materials at the exact instant before detonation to flash powder levels.

11. The diversionary device of claim 6 wherein a flash does not occur until the breakaway hermetic seal bursts under pressure.

* * * * *